US010611550B2

(12) United States Patent
Chung

(10) Patent No.: US 10,611,550 B2
(45) Date of Patent: Apr. 7, 2020

(54) DENT PREVENTION STRUCTURE OF FOOD COOKING CONTAINER

(71) Applicant: TAEBANG PATEC CO., LTD., Yangju, Gyeonggi-do (KR)

(72) Inventor: Hee Kook Chung, Uijeongbu-si (KR)

(73) Assignee: TAEBANG PATEC CO., LTD., Yangju, Gyeonggi-do (KR)

( * ) Notice: Subject to any disclaimer, the term of this patent is extended or adjusted under 35 U.S.C. 154(b) by 164 days.

(21) Appl. No.: 15/303,663

(22) PCT Filed: Aug. 3, 2015

(86) PCT No.: PCT/KR2015/008088
§ 371 (c)(1),
(2) Date: Oct. 12, 2016

(87) PCT Pub. No.: WO2016/117784
PCT Pub. Date: Jul. 28, 2016

(65) Prior Publication Data

US 2017/0036843 A1 Feb. 9, 2017

(30) Foreign Application Priority Data

Jan. 22, 2015 (KR) ..... 10-2015-0010286

(51) Int. Cl.
*B65D 81/34* (2006.01)
*B65D 79/00* (2006.01)
(Continued)

(52) U.S. Cl.
CPC ..... *B65D 81/3453* (2013.01); *B65D 25/38* (2013.01); *B65D 47/32* (2013.01);
(Continued)

(58) Field of Classification Search
CPC ..... B65D 25/00; B65D 25/38; B65D 81/34; B65D 81/3453; B65D 81/3446;
(Continued)

(56) References Cited

U.S. PATENT DOCUMENTS 5,587,192 A * 12/1996 Beizermann ..... B65D 77/225 220/360
6,847,022 B2 * 1/2005 Hopkins, Sr. ..... B65D 77/225 219/725
(Continued)

FOREIGN PATENT DOCUMENTS

JP 3253550 B2 2/2002
JP 2005-059860 A 3/2005
(Continued)

*Primary Examiner* — Anthony D Stashick
*Assistant Examiner* — James M Van Buskirk
(74) *Attorney, Agent, or Firm* — Novick, Kim & Lee, PLLC; Jae Youn Kim

(57) ABSTRACT

The present invention relates generally to a dent prevention structure of a food cooking container. More particularly, the present invention relates to a dent prevention structure of a food cooking container, in which the dent prevention structure allows vapor produced from contents in the container to be discharged to the outside of the container through a discharge hole, and allows outside air to be supplied to an inner space part of the container through the discharge hole, thereby preventing the container from being dented inwards. The dent prevention structure being open at an upper part thereof to store food includes: an inner space part; a flange surface; a main sealing protrusion part; an auxiliary sealing protrusion part; a discharge hole; a sharp part; and protrusion guides.

16 Claims, 8 Drawing Sheets

(51) Int. Cl.
*B65D 25/38* (2006.01)
*B65D 47/32* (2006.01)
*B65D 53/06* (2006.01)

(52) U.S. Cl.
CPC ..... *B65D 53/06* (2013.01); *B65D 79/005* (2013.01); *B65D 2205/00* (2013.01)

(58) Field of Classification Search
CPC ..... B65D 47/32; B65D 53/06; B65D 53/02; B65D 79/005; B65D 2205/00; B65D 77/225; B65D 77/206; B65D 51/1633; B65D 51/1638; Y10S 277/921
USPC ..... 220/359.4, 203.16, 203.29, 360, 364, 220/366.1, 281, 367.1, 202, 203.1; 206/484–484.2; 383/100, 101, 103; 264/153; 426/107, 113
See application file for complete search history.

(56) References Cited

U.S. PATENT DOCUMENTS 8,245,869 B2 * 8/2012 Yasumuro ..... B65D 77/225 220/202
2009/0022858 A1 * 1/2009 Pawlick ..... B65D 81/34 426/113

FOREIGN PATENT DOCUMENTS

KR 10-2009-0068957 B2 6/2009
KR 10-1391841 B1 5/2014

* cited by examiner

DENT PREVENTION STRUCTURE OF FOOD COOKING CONTAINER

TECHNICAL FIELD

The present invention relates generally to a dent prevention structure of a food cooking container. More particularly, the present invention relates to a dent prevention structure of a food cooking container, in which the dent prevention structure allows vapor produced from contents in the container to be discharged to the outside of the container through a discharge hole, and allows outside air to be supplied to an inner space part of the container through the discharge hole, thereby preventing the container from being dented inwards.

BACKGROUND ART

In general, lunch boxes or side dishes, etc. come in a packaging body sealed airtight in a container made of resins so as to prevent foreign matter from coming in it, or to prevent food quality from decreasing. A method in which food is heated in a packaging body by a microwave oven to be cooked is widespread.

However, when food is heated while being sealed airtight in a container, the container may be expanded outward by vapor produced from the food, and be damaged. In addition, fermented food such as kimchi discharges carbon dioxide according to the degree of fermentation, and thus the container may be damaged even when the container is not heated.

In recent years, considering such problems, a container has been developed that can discharge vapor or carbon dioxide produced from food to the outside.

A food cooking container according to the related art is disclosed in Korean Patent No. 10-1391841 entitled, "Food cooking container structure having steam hole" registered by the applicant of the present invention in an earlier filing.

The food cooking container provided with a steam hole is configured to be open at an upper part thereof so as to enable food storage, and the food cooking container provided with a flange surface formed along an upper rim includes: a main sealing protrusion part formed to protrude from the flange surface to a predetermined height along the flange surface so as to be adhered to a cover film for inner sealing; an auxiliary sealing protrusion part formed on the flange surface inside the main sealing protrusion part so as to be adhered to the cover film, the auxiliary sealing protrusion part being connected to the main sealing protrusion part at opposite ends thereof so as to define a discharge space; the steam hole formed on the flange surface having the discharge space defamed thereover to enable discharge of vapor to the outside.

According to the food cooking container, after vapor in the container is discharged through the steam hole to an outside, an internal pressure of the container tends to become lower than external pressure. Accordingly, after being heated, the container may be dented inwards. To solve the above-mentioned problem, a food cooking container according to the present invention has been developed, in which the container is provided with a protrusion guide and an open groove on an inner side of a flange surface such that after vapor is discharged to the outside through a discharge hole, outside air is supplied into the container through the discharge hole, thereby preventing the container from being dented inwards after being heated.

DISCLOSURE

Technical Problem

Accordingly, the present invention has been made keeping in mind the above problems occurring in the related art, and the present invention is intended to propose a dent prevention structure of a food cooking container, in which the dent prevention structure allows vapor produced from contents in the container to be discharged to the outside of the container through a discharge hole, and allows outside air to be supplied to an inner space part of the container through the discharge hole, thereby preventing the container from being dented inwards.

The present invention is still intended to propose a dent prevention structure of a food cooking container, in which the dent prevention structure is provided with a protrusion guide and an open groove on an inner side of a flange surface such that after vapor produced from contents in the container is discharged through a discharge hole, outside air is supplied into the container through the discharge hole, thereby preventing the container from being dented inwards.

Technical Solution

In order to achieve the above object, according to one aspect of the present invention, there is provided a dent prevention structure of a food cooking container, the structure including: an inner space part formed so as to store food; a flange surface formed along an upper rim; a main sealing protrusion part formed on the flange surface by protruding from the flange surface to a predetermined height along the flange surface so as to be adhered to a cover film for inner sealing; an auxiliary sealing protrusion part formed on the flange surface by protruding from the flange surface to a same height of the main sealing protrusion part inside the main sealing protrusion part so as to be adhered to the cover film, the auxiliary sealing protrusion part being connected to the main sealing protrusion part at opposite ends thereof so as to form a discharge space of a predetermined size; a discharge hole formed on the flange surface having the discharge space defamed thereover so as to enable vapor discharge; a sharp part formed on the auxiliary sealing protrusion part to sharply protrude inwards therefrom such that when an internal pressure of the container increases, the cover film adhered to the auxiliary sealing protrusion part can be easily detached; and protrusion guides provided on an inner side of a flange surface by protruding from respective positions on the inner side of the flange surface spaced apart from the sharp part of the auxiliary sealing protrusion part to define an open groove between the protrusion guides such that outside air is supplied into the container through the discharge hole.

The protrusion guides may be slantingly configured to have shapes of slanting protrusion walls so as to be opposed to each other such that a side of the open groove is higher.

Heights of the protrusion guides may be 0.5 to 1 mm higher than a height of an upper part of the auxiliary sealing protrusion part.

The protrusion guides may be provided with the cover film positioned thereon, and when internal pressure of the container increases, the cover film may expand upward, and thus the sharp part of the auxiliary sealing protrusion part may be detached from the cover film, so that vapor in the container is consecutively discharged through the open groove between the protrusion guides, and the discharge hole of the discharge space to an outside of the container, and outside air is consecutively supplied through the discharge hole, the discharge space, and the open groove between the protrusion guides into the inner space part of the container, thereby preventing the container from being dent inward.

According to a dent prevention structure of a food cooking container of the present invention, the structure includes: an inner space part formed so as to store food; a flange surface formed along an upper rim; a main sealing protrusion part formed on the flange surface by protruding from the flange surface to a predetermined height along the flange surface so as to be adhered to a cover film for inner sealing; an auxiliary sealing protrusion part formed on the flange surface by protruding from the flange surface to a same height of the main sealing protrusion part inside the main sealing protrusion part so as to be adhered to the cover film, the auxiliary sealing protrusion part being connected to the main sealing protrusion part at opposite ends thereof so as to form a discharge space of a predetermined size; a discharge hole formed on the flange surface having the discharge space defamed thereover so as to enable vapor discharge; a sharp part formed on the auxiliary sealing protrusion part to sharply protrude inwards therefrom such that when an internal pressure of the container increases, the cover film adhered to the auxiliary sealing protrusion part can be easily detached; a protrusion guide provided on an inner side of a flange surface by protruding from the inner side of the flange surface spaced apart from the sharp part of the auxiliary sealing protrusion part; and open grooves defamed on the flange surface at opposite sides of the protrusion guide.

Each of the open grooves may be a U-shaped groove configured such that the flange surface is depressed downward.

Each of the open grooves may be a rectangular groove configured such that the flange surface is depressed downward.

Each of the open grooves may be a rectangular groove configured such that the flange surface is slanted downward toward the inner space part.

Each of the open grooves may be a U-shaped groove configured such that the flange surface is depressed downward and slanted toward the inner space part.

A height of the protrusion guide may be 0.5 to 1 mm higher than an upper part of the auxiliary sealing protrusion part.

A width of the protrusion guide may be 5 mm to 10 mm, and a width of each of the open grooves may be 3 mm to 5 mm.

The protrusion guide may be provided with the cover film positioned thereon, and when internal pressure of the container increases, the cover film may expand upward, and thus the sharp part of the auxiliary sealing protrusion part may be detached from the cover film, so that vapor in the container is consecutively discharged through the open grooves at the opposite sides of the protrusion guide, and the discharge hole of the discharge space to an outside of the container, and outside air is consecutively supplied through the discharge hole, the discharge space, and the open grooves at the opposite sides of the protrusion guide into the inner space part of the container, thereby preventing the container from being dented inwards.

Advantageous Effects

According to the present invention having the above-described characteristics, it is possible to propose a dent prevention structure of a food cooking container, in which the dent prevention structure allows vapor produced from contents in the container to be discharged to the outside of the container through a discharge hole, and allows outside air to be supplied to an inner space part through the discharge hole, thereby preventing the container from being dented inwards.

In addition, it is possible to propose a dent prevention structure of a food cooking container, in which the dent prevention structure is provided with a protrusion guide and an open groove on an inner side of a flange surface such that after vapor produced from contents in the container is discharged through a discharge hole, outside air is supplied into the container through the discharge hole, thereby preventing the container from being dented inwards.

BEST MODE

Hereinbelow, reference will now be made in greater detail to exemplary embodiments of the present invention, examples of which are illustrated in the accompanying drawings. However, the present invention can be embodied in various ways, and is not limited to the embodiments described below.

Figure 1:
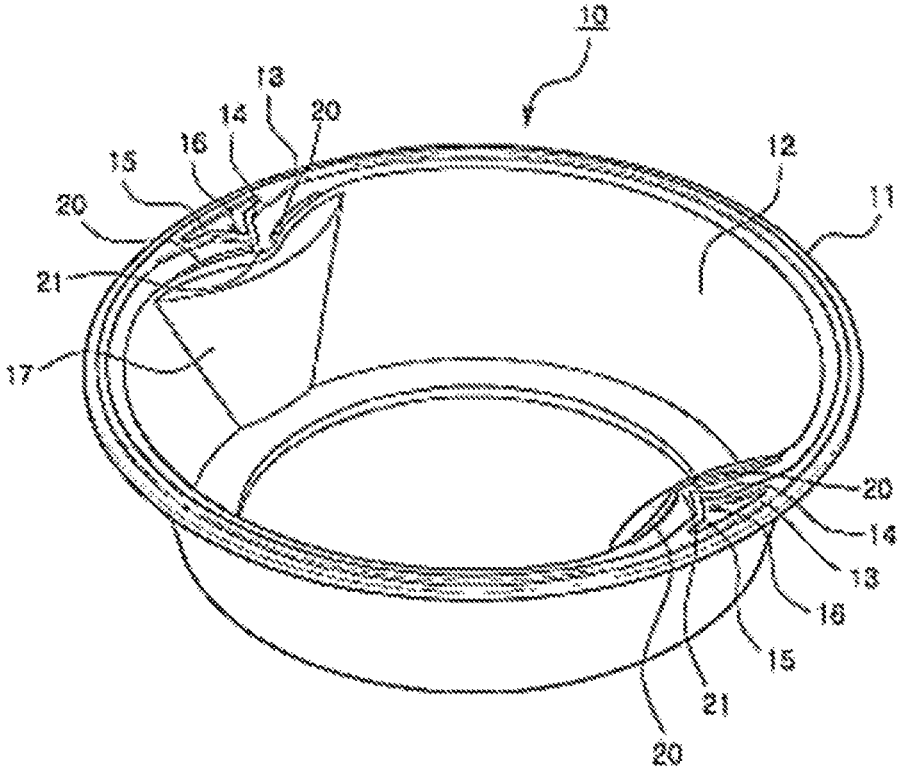
FIG. 1 is a perspective view showing a dent prevention structure of a food cooking container according to a first embodiment of the present invention.
Figure 2:
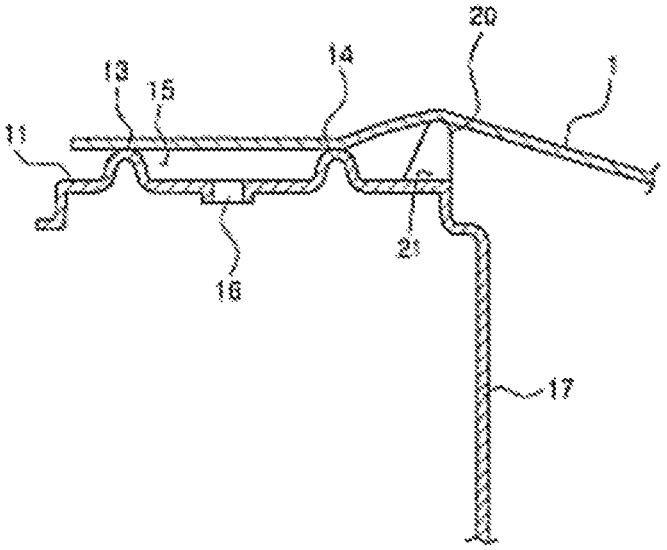
FIG. 2 is a cross-sectional view of an important part of the dent prevention structure of the food cooking container according to the first embodiment of the present invention.
Figure 3:
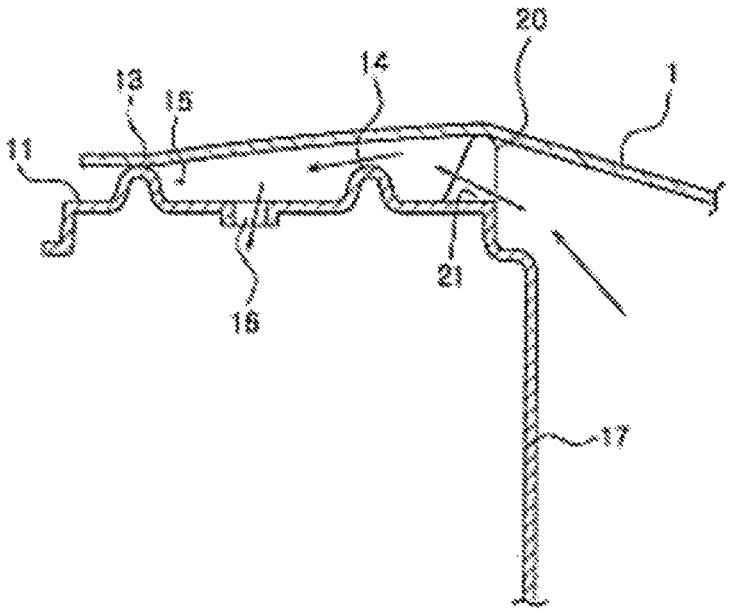
FIG. 3 is a state view of vapor discharged from the inside of the food cooking container according to the first embodiment of the present invention.
Figure 4:
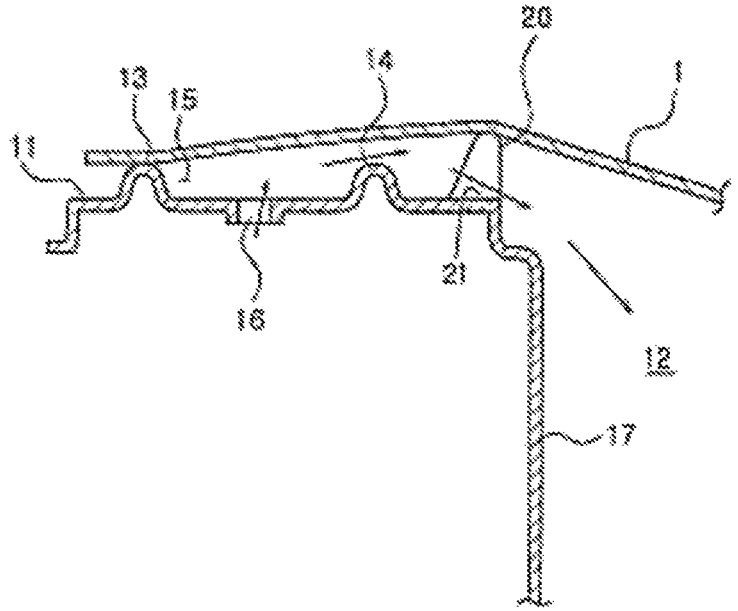
FIG. 4 is a state view of outside air supplied into the food cooking container according to the first embodiment of the present invention.
Figure 5:
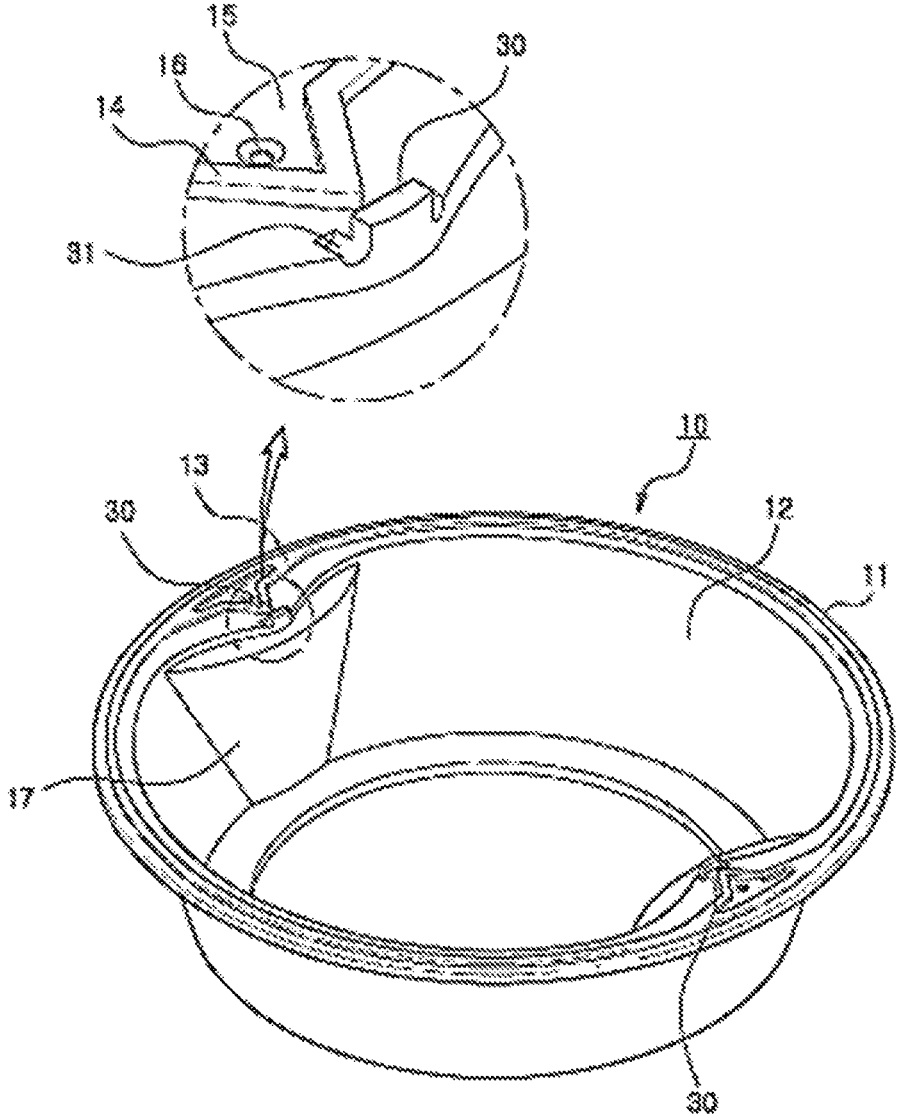
FIG. 5 is a perspective view showing a dent prevention structure of a food cooking container according to a second embodiment of the present invention.
Figure 6:
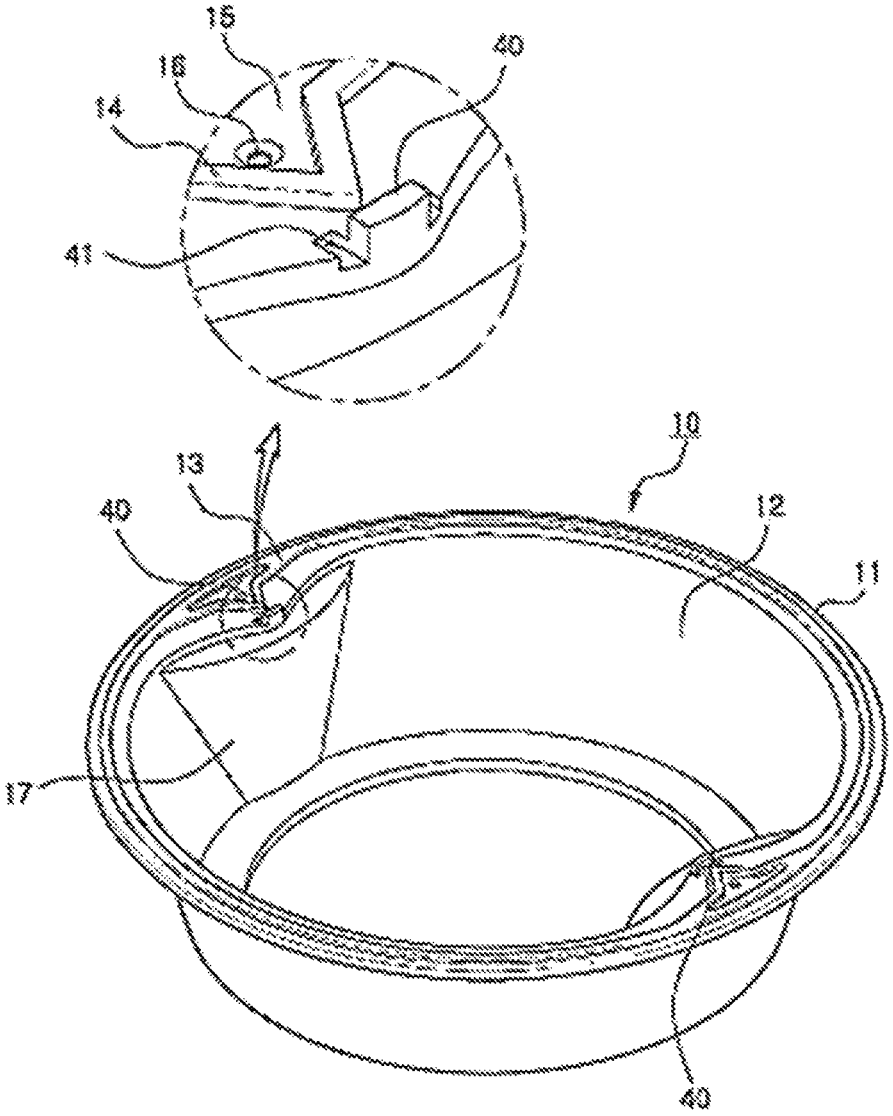
FIG. 6 is a perspective view showing a dent prevention structure of a food cooking container according to a third embodiment of the present invention.
Figure 7:
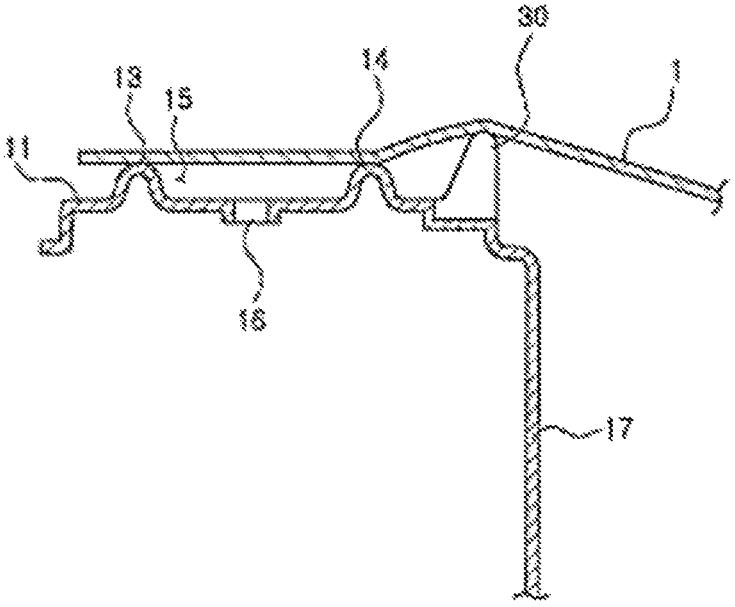
FIG. 7 is a cross-sectional view of an important part of the dent prevention structure of the food cooking container according to the second and third embodiments of the present invention.
Figure 8:
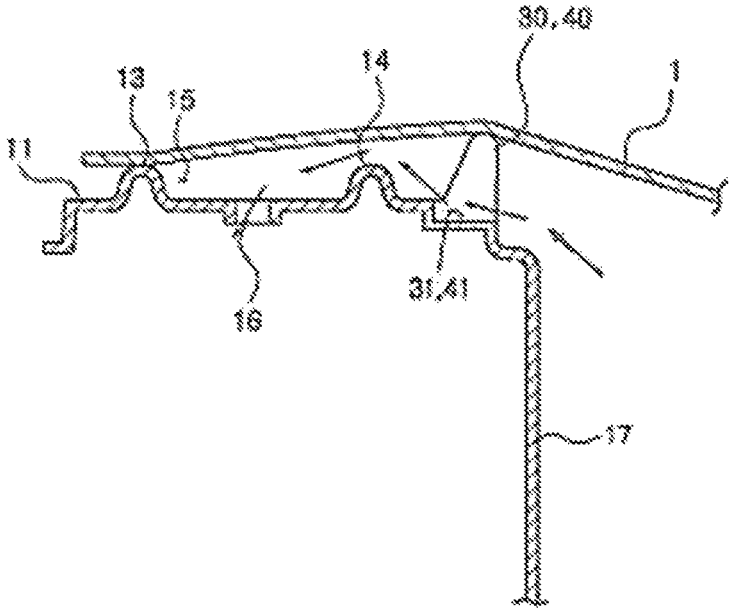
FIG. 8 is a state view of vapor discharged from the inside of the food cooking container according to the second and third embodiments of the present invention.
Figure 9:
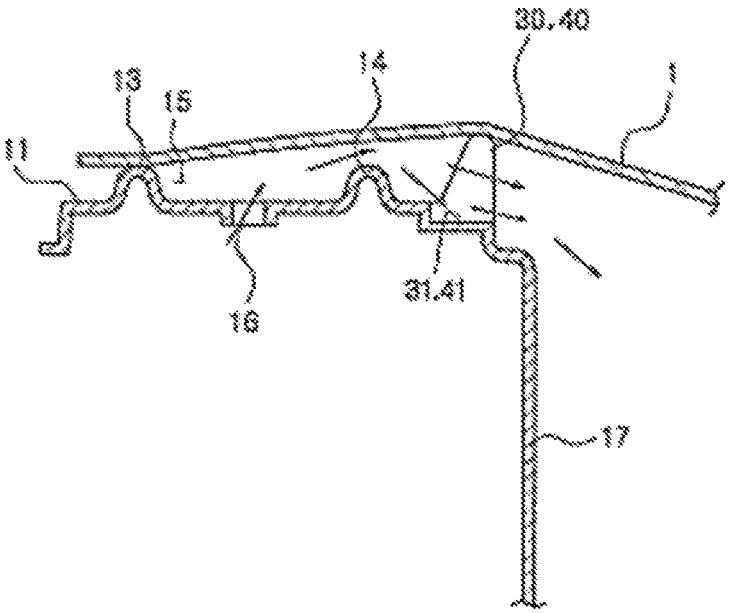
FIG. 9 is a state view of outside air supplied into the food cooking container according to the second and third embodiments of the present invention.
Figure 10:
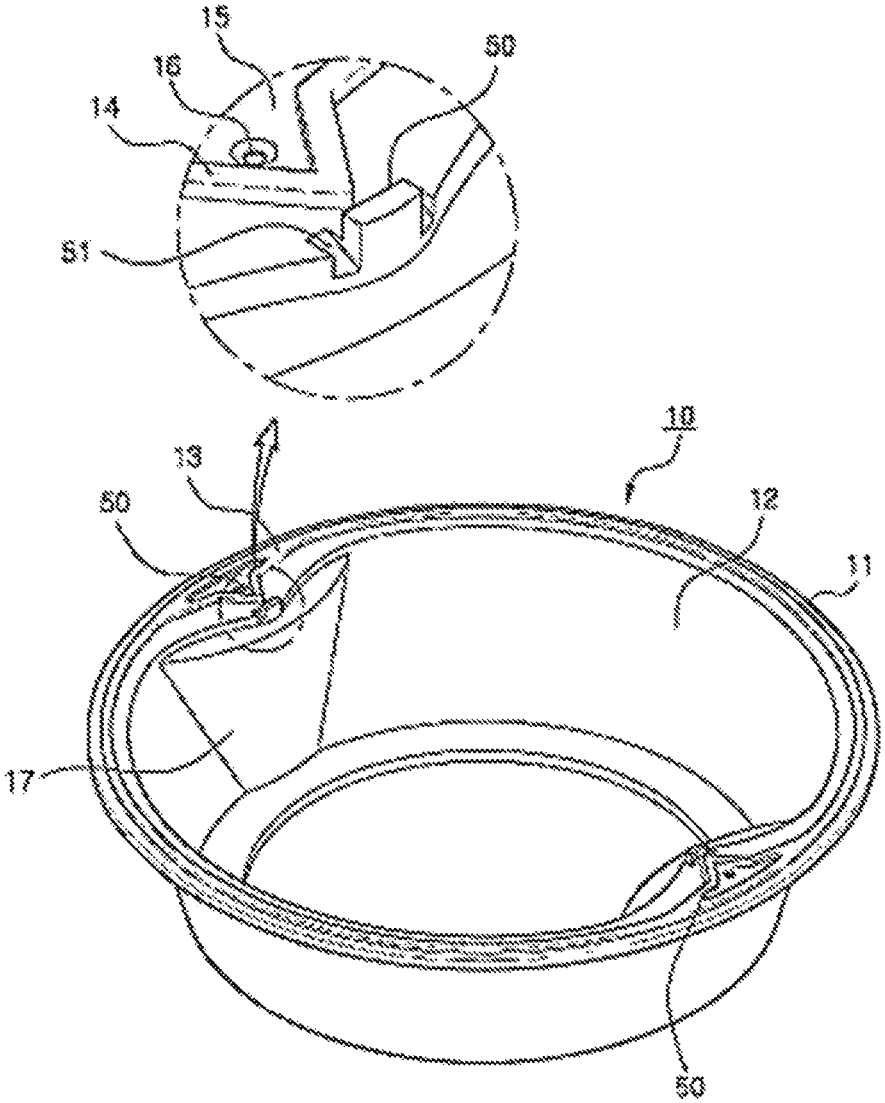
FIG. 10 is a perspective view showing a dent prevention structure of a food cooking container according to a fourth embodiment of the present invention.
Figure 11:
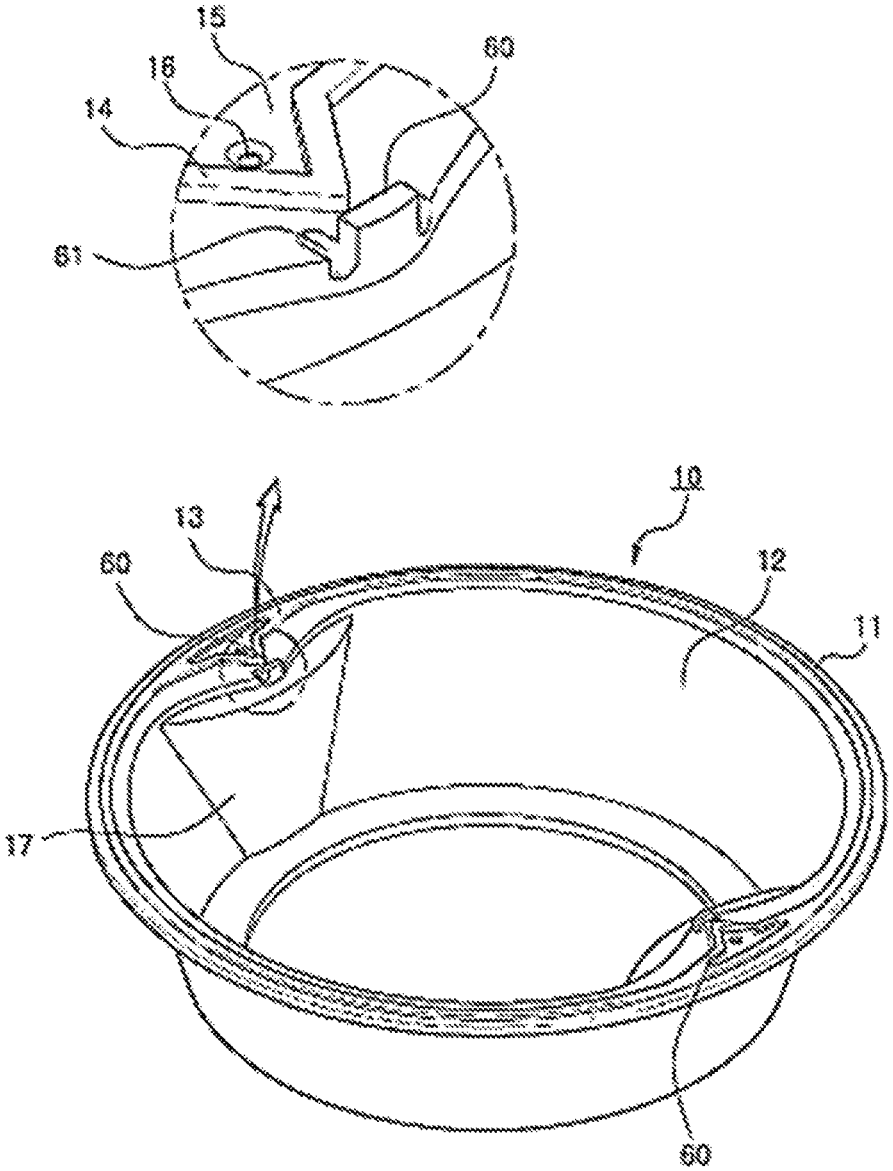
FIG. 11 is a perspective view showing a dent prevention structure of a food cooking container according to a fifth embodiment of the present invention.

FIG. 1 is a perspective view showing a dent prevention structure of a food cooking container according to a first embodiment of the present invention; FIG. 2 is a cross-sectional view of an important part of the dent prevention structure of the food cooking container according to the first embodiment of the present invention; FIG. 3 is a state view of vapor discharged from the inside of the food cooking container according to the first embodiment of the present invention; and FIG. 4 is a state view of outside air supplied into the food cooking container according to the first embodiment of the present invention. In addition, FIG. 5 is a perspective view showing a dent prevention structure of a food cooking container according to a second embodiment of the present invention; FIG. 6 is a perspective view showing a dent prevention structure of a food cooking container according to a third embodiment of the present invention; FIG. 7 is a cross-sectional view of an important part of the dent prevention structure of the food cooking container according to the second and third embodiments of the present invention; FIG. 8 is a state view of vapor discharged from the inside of the food cooking container according to the second and third embodiments of the present invention; FIG. 9 is a state view of outside air supplied into the food cooking container according to the second and third embodiments of the present invention; FIG. 10 is a perspective view showing a dent prevention structure of a food cooking container according to a fourth embodiment of the present invention; and FIG. 11 is a perspective view showing a dent prevention structure of a food cooking container according to a fifth embodiment of the present invention.

The present invention relates generally to a dent prevention structure of a food cooking container. More particularly, the present invention relates to a dent prevention structure of a food cooking container, in which the dent prevention structure allows vapor produced from contents in the container to be discharged to the outside of the container through a discharge hole, and allows outside air to be supplied to an inner space part of the container through the discharge hole, thereby preventing the container from being dented inwards.

As shown in FIGS. 1 to 4, the dent prevention structure of a food cooking container according to the first embodiment of the present invention will be described hereinbelow.

According to the dent prevention structure of a food cooking container of the present invention, the container 10 includes: an inner space part 12 formed so as to store food; a flange surface 11 formed along an upper rim; a main sealing protrusion part 13 formed on the flange surface 11 by protruding from the flange surface to a predetermined height along the flange surface 11 so as to be adhered to a cover film 1 for inner sealing; an auxiliary sealing protrusion part 14 formed on the flange surface 11 by protruding from the flange surface to a same height of the main sealing protrusion part 13 inside the main sealing protrusion part 13 so as to be adhered to the cover film 1, the auxiliary sealing protrusion part being connected to the main sealing protrusion part 13 at opposite ends thereof so as to form a discharge space 15 of a predetermined size; the discharge hole 16 formed on the flange surface 11 having the discharge space 15 defamed thereover so as to enable vapor discharge; a sharp part formed on the auxiliary sealing protrusion part 14 to sharply protrude inwards therefrom such that when an internal pressure of the container 10 increases, the cover film 1 adhered to the auxiliary sealing protrusion part 14 can be easily detached; and protrusion guides 20 provided on an inner side of the flange surface 11 by protruding from respective positions on the inner side of the flange surface spaced apart from the sharp part of the auxiliary sealing protrusion part 14 to define an open groove 21 between the protrusion guides such that outside air is supplied into the container through the discharge hole 16.

The inner space part 12 defamed below the inside of the protrusion guides 20 is provided with the protrusion part 17 which is convex inwards on an inner surface thereof.

The protrusion guides 20 are slantingly configured to have shapes of slanting protrusion walls so as to be opposed to each other such that a side of the open groove 21 is higher.

Heights of the protrusion guides 20 are 0.5 to 1 mm higher than a height of an upper part of the auxiliary sealing protrusion part 14, such that when the cover film 1 expanded upward by the internal pressure of the container returns to an original state, the protrusion guides 20 temporarily support the cover film, so that air outside the container is efficiently introduced into the container.

The protrusion guides 20 are provided with the cover film 1 positioned thereon, and when internal pressure of the container 10 increases, the cover film 1 expands upward, and thus the sharp part of the auxiliary sealing protrusion part 14 is detached from the cover film 1, so that vapor in the container 10 is consecutively discharged through the open groove 21 between the protrusion guides 20, and the discharge hole 16 of the discharge space 15 to an outside of the container 10, and outside air is consecutively supplied through the discharge hole 16, the discharge space 15, and the open groove 21 between the protrusion guides 20 into the inner space part 12 of the container 10, thereby preventing the container 10 from being dent inward.

Hereinbelow operation effects according to the use of the food cooking container 10 having the above-mentioned configuration of the present invention will be described.

The container 10 of the present invention is configured in such a manner that when the container has food for cooking kept therein, the main sealing protrusion part 13 on the flange surface 11, and the auxiliary sealing protrusion part 14 provided inside the main sealing protrusion part 13 have the cover film 1 adhered thereto, thereby realizing sealing packaging via double sealing.

Since the main sealing protrusion part 13 is provided on the flange surface 11 by protruding from the flange surface 11, and the auxiliary sealing protrusion part 14 is provided inside the main sealing protrusion part to protrude in a shape of a protrusion, food or moisture is not left on upper parts of the main sealing protrusion part 13 and the auxiliary sealing protrusion part 14, and falls down from the upper parts. Accordingly, when the upper parts of the main sealing protrusion part 13 and the auxiliary sealing protrusion part 14 are sealed by the cover film 1, the cover film is properly adhered to the upper parts by predetermined pressure applied thereto, so that food in the container 10 is packaged to be sealed airtight.

In the above-mentioned state, when the food cooking container 10 is put in a microwave oven, and food in the container is heated to be cooked, internal pressure of the container is increased by vapor produced from the food.

When the internal pressure of the container 10 reaches a predetermined pressure or more, vapor in the container 10 moves through the open groove 21 between the protrusion guides 20 provided on the respective positions, and weakens a sealing force of the sharp part of the auxiliary sealing protrusion part 14. Accordingly, the cover film 1 is detached from the sharp part of the auxiliary sealing protrusion part 14, and thus high-pressure vapor moves to the discharge space 15, and as shown in FIG. 3, is discharged to the discharge hole 16.

In this case, as the internal pressure concentrates on the sharp part of the auxiliary sealing protrusion part 14, the cover film 1 is detached from the sharp part, thereby enabling efficient discharge of vapor to the discharge hole 16.

Meanwhile, despite vapor discharge of such high pressure, the main sealing protrusion part 13 provided along a rim of the container continuously maintains a state sealed by the cover film 1, and thus prevents extreme discharge of vapor, thereby preventing spattering of food and dirtying of a microwave oven inner wall caused by the damage of the cover film 1.

In the above-mentioned state, outside air consecutively passes through the discharge hole 16 of the container, the discharge space 15, and the open groove 21 between the protrusion guides 20, and then is supplied to the inner space part 12 of the container 10, thereby preventing the container 10 from being dented inwards.

As mentioned above, when vapor in the container 10 is discharged through the discharge hole 16 to the outside, movement of the vapor produced in the container can be controlled by the protrusion guides 20.

Accordingly, the vapor can move throughout the inside of the container 10, thereby enabling even heating of contents in the container, and efficient discharge of the vapor from the inside of the container.

In addition, when the cover film 1 expanded upward by the internal pressure of the container returns to an original state, the protrusion guides 20 temporarily support the cover film 1, so that air outside the container is efficiently introduced into the container.

Accordingly, after vapor in the container 10 is discharged through the discharge hole 16 to the outside, the container can be prevented from being dented inwards.

As shown in FIGS. 5 to 11, a dent prevention structure of a food cooking container according to the second to fifth embodiments of the present invention will be described hereinbelow.

According to the dent prevention structure of a food cooking container, the container 10 includes: an inner space part 12 formed so as to store food; a flange surface 11 formed along an upper rim; a main sealing protrusion part 13 formed on the flange surface 11 by protruding from the flange surface to a predetermined height along the flange surface 11 so as to be adhered to a cover film 1 for inner sealing; an auxiliary sealing protrusion part 14 formed on the flange surface 11 by protruding from the flange surface to a same height of the main sealing protrusion part 13 inside the main sealing protrusion part 13 so as to be adhered to the cover film 1, the auxiliary sealing protrusion part being connected to the main sealing protrusion part 13 at opposite ends thereof so as to form a discharge space 15 of a predetermined size; a discharge hole 16 formed on the flange surface 11 having the discharge space 15 defamed thereover so as to enable vapor discharge; a sharp part formed on the auxiliary sealing protrusion part 14 to sharply protrude inwards therefrom such that when an internal pressure of the container 10 increases, the cover film 1 adhered to the auxiliary sealing protrusion part 14 can be easily detached; a protrusion guide 30, 40, 50, 60 provided on an inner side of the flange surface 11 by protruding from the inner side of the flange surface spaced apart from the sharp part of the auxiliary sealing protrusion part 14; and open grooves 31, 41, 51, 61 defamed on the flange surface 11 at opposite sides of the protrusion guide 30, 40, 50, 60.

The inner space part 12 defamed below the inside of the protrusion guide is provided with the protrusion part 17 which is convex inwards on an inner surface thereof.

As shown in FIG. 5, each of the open grooves 31 is a U-shaped groove configured such that the flange surface 11 is depressed downward.

As shown in FIG. 6, each of the open grooves 41 is a rectangular groove configured such that the flange surface 11 is depressed downward.

As shown in FIG. 10, each of the open grooves 51 is a rectangular groove configured such that the flange surface 11 is slanted downward toward the inner space part.

As shown in FIG. 11, each of the open grooves 61 is a U-shaped groove configured such that the flange surface is depressed downward and slanted toward the inner space part.

A height of the protrusion guide 30, 40, 50, 60 is 0.5 to 1 mm higher than an upper part of the auxiliary sealing protrusion part 14, such that when the cover film 1 expanded upward by the internal pressure of the container returns to an original state, the protrusion guide 30, 40, 50, 60 temporarily supports the cover film 1, so that air outside the container is efficiently introduced into the container.

A width of the protrusion guide 30, 40, 50, 60 is 5 mm to 10 mm, and a width of each of the open grooves 31, 41, 51, 61 is 3 mm to 5 mm.

The protrusion guide 30, 40, 50, 60 is provided with the cover film 1 positioned thereon, and when internal pressure of the container 10 increases, the cover film 1 expands upward, and thus the sharp part of the auxiliary sealing protrusion part 14 is detached from the cover film 1, so that vapor in the container 10 is consecutively discharged through the open grooves 31, 41, 51, 61 at the opposite sides of the protrusion guide, and the discharge hole 16 of the discharge space 15 to an outside of the container, and outside air is consecutively supplied through the discharge hole 16, the discharge space 15, and the open grooves 31, 41, 51, 61 at the opposite sides of the protrusion guide 30,40, 50, 60 into the inner space part 12 of the container 10, thereby preventing the container 10 from being dented inwards.

Hereinbelow operation effects according to the use of the food cooking container 10 having the above-mentioned configuration according to the second embodiment to the fifth embodiment of the present invention will be described.

When the food cooking container 10 of the present invention is put in a microwave oven, and food in the container is heated to be cooked, the internal pressure of the container is increased by vapor produced from the food.

When the internal pressure of the container 10 reaches a predetermined pressure or more, vapor in the container 10 moves through the open grooves 31, 41, 51, 61 at the opposite sides of the protrusion guide 30, 40, 50, 60, and weakens a sealing force of the sharp part of the auxiliary sealing protrusion part 14. Accordingly, the cover film 1 is detached from the sharp part of the auxiliary sealing protrusion part 14, and thus high-pressure vapor moves to the discharge space 15, and as shown in FIG. 8, is discharged to the discharge hole 16.

In this case, as the internal pressure concentrates on the sharp part of the auxiliary sealing protrusion part 14, the cover film 1 is detached from the sharp part, thereby enabling efficient discharge of vapor to the discharge hole 16.

Meanwhile, despite vapor discharge of such high pressure, the main sealing protrusion part 13 provided along a rim of the container continuously maintains a state sealed by the cover film 1, and thus prevents extreme discharge of vapor, thereby preventing spattering of food and the dirtying of a microwave oven inner wall caused by damage of the cover film 1.

In the above-mentioned state, as shown in FIG. 9, outside air consecutively passes through the discharge hole 16 of the container, the discharge space 15, and the open grooves 31,41 at the opposite sides of the protrusion guide 30, 40, and then is supplied to the inner space part 12 of the container 10, thereby preventing the container 10 from being dented inwards.

As mentioned above, when vapor in the container 10 is discharged through the discharge hole 16 to an outside, movement of the vapor produced in the container can be controlled by the protrusion guide 30, 40.

Accordingly, the vapor can move throughout the inside of the container 10, thereby enabling even heating of contents in the container, and efficient discharge of the vapor from the inside of the container.

In addition, when the cover film 1 expanded upward by the internal pressure of the container returns to an original state, the protrusion guide 30, 40, 50, 60 temporarily supports the cover film 1, so that air outside the container is efficiently introduced into the container.

Accordingly, after vapor in the container 10 is discharged through the discharge hole 16 to the outside, the container can be prevented from being dented inwards.

As mentioned above, the inner side of the flange surface is provided with the protrusion guide and the open grooves thereon such that after vapor in the food cooking container is discharged through the discharge hole to the outside, outside air is supplied through the discharge hole into the container, thereby preventing the container from being dented inwards.

Although the preferred embodiments of the present invention have been described, various changes, modifications, and equivalents can be used. It is obvious that the present invention can be applied with proper modifications without departing from the scope and spirit of the invention. Accordingly, the descriptions of the present invention as mentioned above do not limit the scope of the present invention without departing from the scope and spirit of the invention.

Meanwhile, although the preferred embodiments of the present invention have been disclosed for illustrative purposes, those skilled in the art will appreciate that various modifications, additions and substitutions are possible, without departing from the scope and spirit of the invention as disclosed in the accompanying claims.

| <Description of the Reference Numerals in the Drawings> | |
|---|---|
| 1: Cover film | 10: Container |
| 11: Flange surface | 12: Inner space part |
| 13: Main sealing protrusion part | |
| 14: Auxiliary sealing protrusion part | |
| 15: Discharge space | 16: Discharge hole |
| 17: Protrusion part | |
| 20, 30, 40, 50, 60: Protrusion guide | |
| 21, 31, 41, 51, 61: Open groove | |

The invention claimed is:

1. A dent prevention structure of a food cooking container, the structure comprising:

an inner space part formed so as to store food;

a flange surface formed along an upper rim;

a main sealing protrusion part formed on the flange surface by protruding from the flange surface to a height along the flange surface so as to be adhered to a cover film for inner sealing;

an auxiliary sealing protrusion part formed on the flange surface by protruding from the flange surface in an inner position from the main sealing protrusion part to the same height of the main sealing protrusion part so as to be adhered to the cover film, the auxiliary sealing protrusion part being connected to the main sealing protrusion part at opposite ends of a discharge space;

a discharge hole formed on the flange surface having the discharge space defined thereover so as to enable vapor discharge;

a sharp part formed on the auxiliary sealing protrusion part to acutely protrude inwards therefrom such that when an internal pressure of the container increases, the cover film adhered to the auxiliary sealing protrusion part can be easily detached; and protrusion guides provided on an inner side of the flange surface by protruding from respective positions on the inner side of the flange surface spaced apart from the sharp part of the auxiliary sealing protrusion part to define an open groove between the protrusion guides such that outside air is supplied into the container through the discharge hole, wherein heights of the protrusion guides are respectively 0.5 to 1 mm higher than a height of an upper part of the auxiliary sealing protrusion part.

2. The structure of claim 1, wherein the protrusion guides are disposed to oppose each other and have slanting protrusion walls such that the open groove is slanted.

3. The structure of claim 1, wherein the protrusion guides are provided with the cover film positioned thereon, and when internal pressure of the container increases, the cover film expands upward, and thus the sharp part of the auxiliary sealing protrusion part is detached from the cover film, so that vapor in the container is consecutively discharged through the open groove between the protrusion guides, and the discharge hole of the discharge space to an outside of the container, and outside air is consecutively supplied through the discharge hole, the discharge space, and the open groove between the protrusion guides into the inner space part of the container, thereby preventing the container from being dent inward.

4. The structure of claim 2, wherein the protrusion guides are provided with the cover film positioned thereon, and when internal pressure of the container increases, the cover film expands upward, and thus the sharp part of the auxiliary sealing protrusion part is detached from the cover film, so that vapor in the container is consecutively discharged through the open groove between the protrusion guides, and the discharge hole of the discharge space to an outside of the container, and outside air is consecutively supplied through the discharge hole, the discharge space, and the open groove between the protrusion guides into the inner space part of the container, thereby preventing the container from being dent inward.

5. A dent prevention structure of a food cooking container, the structure comprising:

an inner space part formed so as to store food;

a flange surface formed along an upper rim;

a main sealing protrusion part formed on the flange surface by protruding from the flange surface to a height along the flange surface so as to be adhered to a cover film for inner sealing;

an auxiliary sealing protrusion part formed on the flange surface by protruding from the flange surface in an inner position from the main sealing protrusion part to the same height of the main sealing protrusion part so as to be adhered to the cover film, the auxiliary sealing protrusion part being connected to the main sealing protrusion part at opposite ends of a discharge space;

a discharge hole formed on the flange surface having the discharge space defined thereover so as to enable vapor discharge;

a sharp part formed on the auxiliary sealing protrusion part to acutely protrude inwards therefrom such that when an internal pressure of the container increases, the cover film adhered to the auxiliary sealing protrusion part can be easily detached;

a protrusion guide provided on an inner side of the flange surface by protruding from the inner side of the flange surface spaced apart from the sharp part of the auxiliary sealing protrusion part; and open grooves defined on the flange surface at opposite sides of the protrusion guide, wherein a height of the protrusion guide is 0.5 to 1 mm higher than a height of an upper part of the auxiliary sealing protrusion part.

6. The structure of claim 5, wherein each of the open grooves is a U-shaped groove configured such that the flange surface is depressed downward.

7. The structure of claim 6, wherein the protrusion guide is provided with the cover film positioned thereon, and when internal pressure of the container increases, the cover film expands upward, and thus the sharp part of the auxiliary sealing protrusion part is detached from the cover film, so that vapor in the container is consecutively discharged through the open grooves at the opposite sides of the protrusion guide, and the discharge hole of the discharge space to an outside of the container, and outside air is consecutively supplied through the discharge hole, the discharge space, and the open grooves at the opposite sides of the protrusion guide into the inner space part of the container, thereby preventing the container from being dented inwards.

8. The structure of claim 5, wherein each of the open grooves is a rectangular groove configured such that the flange surface is depressed downward.

9. The structure of claim 8, wherein the protrusion guide is provided with the cover film positioned thereon, and when internal pressure of the container increases, the cover film expands upward, and thus the sharp part of the auxiliary sealing protrusion part is detached from the cover film, so that vapor in the container is consecutively discharged through the open grooves at the opposite sides of the protrusion guide, and the discharge hole of the discharge space to an outside of the container, and outside air is consecutively supplied through the discharge hole, the discharge space, and the open grooves at the opposite sides of the protrusion guide into the inner space part of the container, thereby preventing the container from being dented inwards.

10. The structure of claim 5, wherein each of the open grooves is a rectangular groove configured such that the flange surface is slanted downward toward the inner space part.

11. The structure of claim 10, wherein the protrusion guide is provided with the cover film positioned thereon, and when internal pressure of the container increases, the cover film expands upward, and thus the sharp part of the auxiliary sealing protrusion part is detached from the cover film, so that vapor in the container is consecutively discharged through the open grooves at the opposite sides of the protrusion guide, and the discharge hole of the discharge space to an outside of the container, and outside air is consecutively supplied through the discharge hole, the discharge space, and the open grooves at the opposite sides of the protrusion guide into the inner space part of the container, thereby preventing the container from being dented inwards.

12. The structure of claim 5, wherein each of the open grooves is a U-shaped groove configured such that the flange surface is depressed downward and slanted toward the inner space part.

13. The structure of claim 12, wherein the protrusion guide is provided with the cover film positioned thereon, and when internal pressure of the container increases, the cover film expands upward, and thus the sharp part of the auxiliary sealing protrusion part is detached from the cover film, so that vapor in the container is consecutively discharged through the open grooves at the opposite sides of the protrusion guide, and the discharge hole of the discharge space to an outside of the container, and outside air is consecutively supplied through the discharge hole, the discharge space, and the open grooves at the opposite sides of the protrusion guide into the inner space part of the container, thereby preventing the container from being dented inwards.

14. The structure of claim 5, wherein a width of the protrusion guide is 5 mm to 10 mm, and a width of each of the open grooves is 3 mm to 5 mm.

15. The structure of claim 14, wherein the protrusion guide is provided with the cover film positioned thereon, and when internal pressure of the container increases, the cover film expands upward, and thus the sharp part of the auxiliary sealing protrusion part is detached from the cover film, so that vapor in the container is consecutively discharged through the open grooves at the opposite sides of the protrusion guide, and the discharge hole of the discharge space to an outside of the container, and outside air is consecutively supplied through the discharge hole, the discharge space, and the open grooves at the opposite sides of the protrusion guide into the inner space part of the container, thereby preventing the container from being dented inwards.

16. The structure of claim 5, wherein the protrusion guide is provided with the cover film positioned thereon, and when internal pressure of the container increases, the cover film expands upward, and thus the sharp part of the auxiliary sealing protrusion part is detached from the cover film, so that vapor in the container is consecutively discharged through the open grooves at the opposite sides of the protrusion guide, and the discharge hole of the discharge space to an outside of the container, and outside air is consecutively supplied through the discharge hole, the discharge space, and the open grooves at the opposite sides of the protrusion guide into the inner space part of the container, thereby preventing the container from being dented inwards.

* * * * *